United States Patent [19]

Galvin et al.

[11] Patent Number: 4,636,774

[45] Date of Patent: Jan. 13, 1987

[54] VARIABLE SENSITIVITY MOTION DETECTOR

[75] Inventors: Aaron A. Galvin, Lexington; James B. Edson, Concord; John K. Guscott, Lynnfield, all of Mass.

[73] Assignee: American District Telegraph Company, New York, N.Y.

[21] Appl. No.: 549,987

[22] Filed: Nov. 8, 1983

[51] Int. Cl.[4] ..... G08B 13/00; G10K 11/00

[52] U.S. Cl. ..... 340/565; 340/541; 307/117; 367/197

[58] Field of Search ..... 340/565, 527, 566, 561, 340/567, 553, 555, 552, 551, 547, 541, 545; 307/117; 367/197, 198, 199

[56] References Cited

U.S. PATENT DOCUMENTS

| | | | |
|---|---|---|---|
| 4,225,808 | 9/1980 | Saraceni | 340/541 X |
| 4,277,727 | 7/1981 | LeVert | 340/556 X |
| 4,333,093 | 6/1982 | Raber et al. | 340/566 |
| 4,344,071 | 8/1982 | Allen | 340/566 |
| 4,408,308 | 10/1983 | Smith et al. | 340/565 X |
| 4,433,328 | 2/1984 | Saphir et al. | 340/555 |
| 4,437,089 | 3/1984 | Achard | 340/541 |

FOREIGN PATENT DOCUMENTS

| | | |
|---|---|---|
| 361812 | 4/1981 | Austria . |
| 2205634 | 8/1972 | Fed. Rep. of Germany . |
| 2707181 | 9/1977 | Fed. Rep. of Germany . |
| 2737324 | 2/1979 | Fed. Rep. of Germany . |

*Primary Examiner*—James L. Rowland
*Assistant Examiner*—Jeffery A. Hofsass
*Attorney, Agent, or Firm*—Weingarten, Schurgin, Gagnebin & Hayes

[57] ABSTRACT

The motion detector of the present invention, together with associated AC switching circuitry form a lighting control system which turns on room lights when the room is occupied, and extinguishes the lights when unoccupied. The detector sensitivity or threshold is adjusted in response to the previously detected conditions, providing reliable indication of both entry and continued presence in the controlled area, and producing few false alarms. The present embodiment of the invention has two threshold levels of detection, the higher level being used to detect initial entry into the room. After entry is detected, the motion detector lowers the threshold to detect the weaker signals usually occurring for continued presence in the area of the detector. When the occupant leaves the area, the motion detector threshold or sensitivity returns to the original value after a timeout period.

9 Claims, 2 Drawing Figures

VARIABLE SENSITIVITY MOTION DETECTOR

FIELD OF THE INVENTION

The present invention relates to motion detectors, and in particular to motion detectors having variable sensitivity to be used in conjunction with light-controlling systems.

BACKGROUND OF THE INVENTION

Lighting control over specific areas is desirable so that areas not occupied can have their lights extinguished, thereby conserving substantial electrical energy. Motion detectors such as microwave detectors, passive infrared detectors, ultrasonic detectors, and other active or passive devices can be used for both burglar alarm detection and light control systems. When the building is not occupied, a motion detector is used for security or entry detection. When the building is occupied, the same sensor can be used to control the lighting.

When used to control lighting, the motion detector should be sensitive to initial motion without producing false alarms, which would unnecessarily turn on the room lights. However, if the motion detector is adjusted to minimize false entry alarms, motion associated with a subsequent low-activity task such as reading, may not be detected and the lights would then be extinguished. Utilizing a higher detector sensitivity (or lower detection threshold) would permit detection of the continued presence, but would make the lighting control system vulnerable to false alarms during the unoccupied time, which will cause the lights to come on, reducing the power savings to be produced by the light control system. Therefore a motion detector having a fixed sensitivity for all applications will either have an excessive number of false alarms for a room-unoccupied condition, or a limitation in the inability to detect a continued presence within the room.

BRIEF DESCRIPTION OF THE INVENTION

The dual-sensitivity motion detector according to the present invention optimally operates automatic lighting control systems by selecting the detection sensitivity in response to the motions previously detected. Initial-entry false alarms are reduced by providing an initial low sensitivity to detect the initial motion within or entry into an area. When initial entry motion is detected, the lights are turned on and the detection sensitivity increased to detect continued presence within the room. The increased sensitivity is maintained for a specified period of time while the lights are on. After a period of no detected motion, the lights are extinguished and the sensitivity is reset to the lower value.

BRIEF DESCRIPTION OF THE DRAWING

These and other features of the present invention are better understood by reading the following detailed description, taken together with the drawing, wherein.

DETAILED DESCRIPTION OF THE INVENTION

Figure 1:
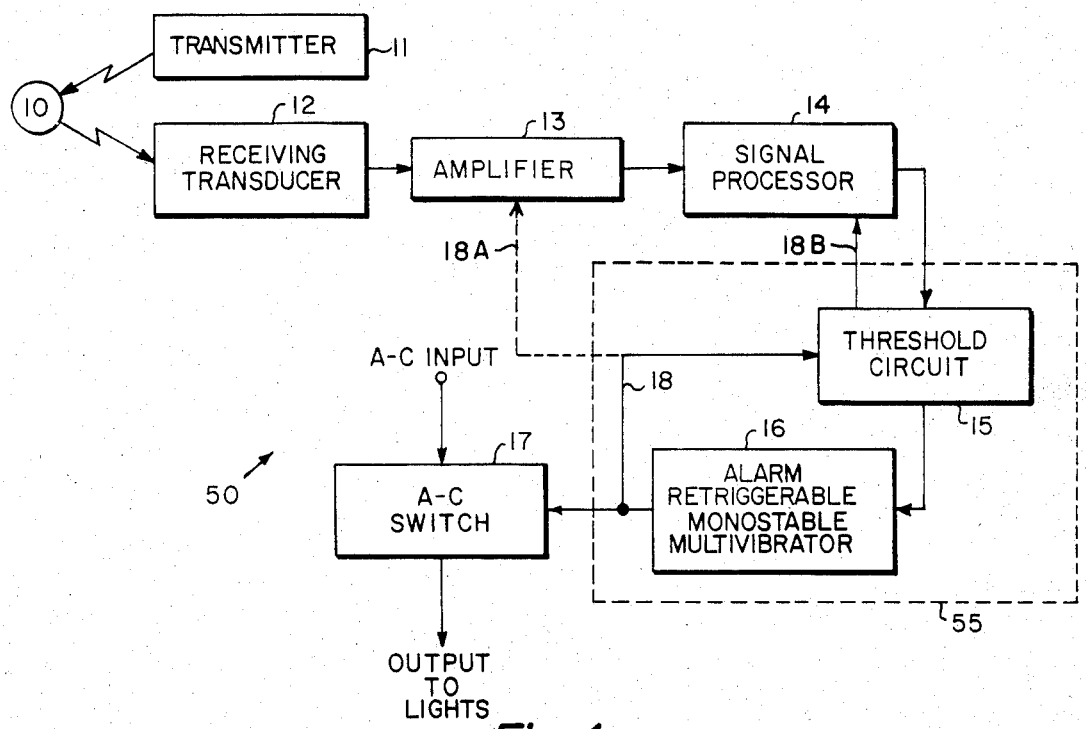
FIG. 1 is a block diagram of the motion detector including a light control switch.

Referring to the system 50 shown in FIG. 1, a transmitter 11 illuminates the area being controlled with a signal. The signal produced by the transmitter is reflected from the subject 10 and received by a receiving transducer 12, and is amplified by amplifier 13. The resulting signal is processed by a signal processor 14 and in turn received by a threshold circuit 15. The threshold circuit 15 returns a control signal to the signal processor 14. The above-described function blocks are well known in the art of microwave, ultrasonic, infrared, and audio motion detectors, and therefore are not discussed in detail here.

The threshold circuit 15 compares the signal processor 14 output to a predetermined threshold, producing a signal received by a retriggerable monostable multivibrator 16, whose output in turn enables an AC switch 17 to control the desired light circuit. Generally, the greater the motion, the higher the signal produced by the signal processor 14. To detect a lesser motion, the threshold circuit 15 sensitivity is increased by reducing the predetermined threshold. Alternatively, to reduce the number of false alarms from extraneous signals, the sensitivity of the threshold circuit 15 is reduced by increasing the threshold. The monostable multivibrator 16 maintains an alarm state for a specified period, say five to fifteen minutes, turning on the lights connected to the associated switch 17 for that period.

When the monostable multivibrator 16 produces an alarm signal, the threshold circuit is adjusted by the alarm signal on lead 18 to reduce the threshold, thereby raising the sensitivity of the threshold circuit 15, such that subsequent motions, although having a lesser amplitude than the initial room-entry motion detected will also produce an output which exceeds the threshold, retriggering the monostable multivibrator 16, thus causing the switch 17 to keep the lights on. If no subsequent signals are detected, the monostable multivibrator times out, resetting the threshold to the initial value and disabling the switch 17, turning the connected lights off.

An alternative embodiment provides the amplifier 13 gain to be modified in response to the alarm condition produced by the monostable multivibrator 16 by a signal along path 18A. In so doing, the amplifier 13 gain is increased after the alarm condition is produced. In this embodiment, the threshold circuit, having a constant threshold reference, will produce a signal corresponding to a motion less than the initial detected object motion due to the increase in the gain of amplifier 13.

Figure 2:
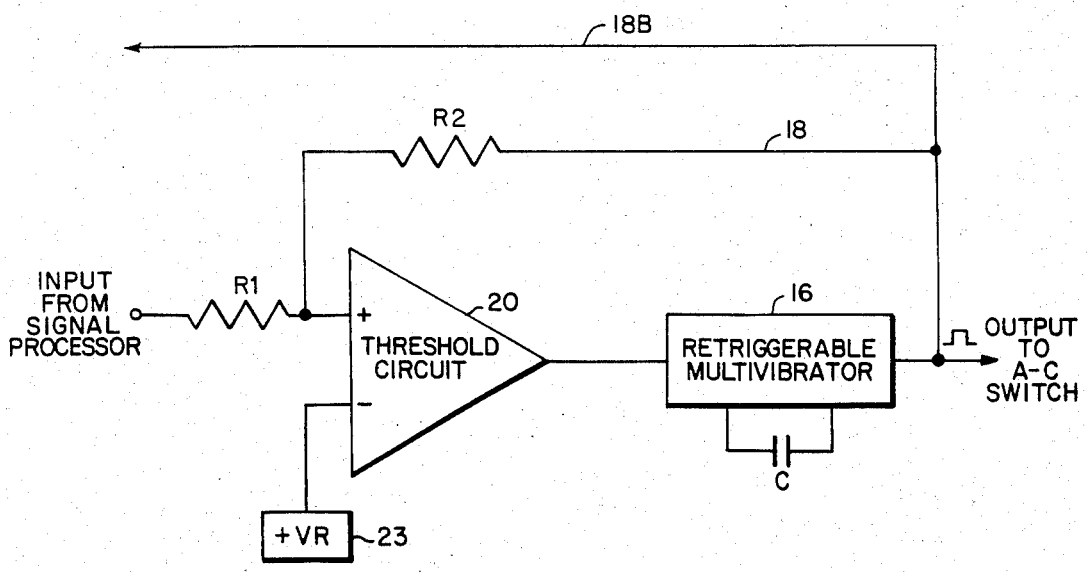
FIG. 2 is a schematic diagram of one embodiment of the threshold adjustment of the detector of FIG. 1.

A schematic diagram 55 of a particular embodiment of a portion 55 of the motion detector is shown in FIG. 2. The retriggerable monostable multivibrator 16 is triggered by a signal from the threshold circuit, including a comparator 20 and voltage divider comprising resistors $R_1$ and $R_2$. The threshold circuit comparator 20 is connected to a positive ($+V_R$) reference source 23, and the signal from the signal processor is received by the comparator 20 through the resistor $R_1$. If the monostable multivibrator 16 is in the quiescent state, the output is nominally zero (0) volts. Therefore, the signal received by the threshold circuit comparator 20 is equal to the voltage received multiplied by the ratio $R_2/(R_1+R_2)$. The resulting voltage divider signal must exceed $+V_R$ to change the output voltage of the comparator 20. However, once the comparator 20 circuit output changes, the multivibrator 16 produces a positive output, and the comparator 20 receives an increased voltage relative to the signal processor 14 output ($+V_{sig}$). The motion signal is increased by an amount which is proportional to the difference between $V_{out}$ (the output which the multivibrator 16 produces when triggered) and $V_{sig}$, thereby effectively raising the circuit sensitivity. The quiescent (no motion) signal received by the threshold circuit 20 is closer to the positive reference voltage $+V_R$, so that lesser signal processor 14 signals can produce a signal output from the threshold comparator 20. More particularly, the comparator 20 produces an output when $$V_{sig}+[R_1/(R_1+R_2)][V_{out}-V_{sig}]>V_R$$

Increased sensitivity also can be produced during the timeout period by feeding a control voltage 18B from multivibrator 16 into the signal integrator of the signal processor 14, which will decrease the integrator's time constant, causing the signal processor to respond to shorter durations of target motion. This faster response would provide an increased likelihood that the output of the processor will rise to exceed the threshold when the target is present.

The above description applies to an "active" motion detection system wherein a signal is radiated from a central location. However, "passive" motion detectors, which receive signals generated by the moving object itself, can be easily incorporated by those skilled in the art, and systems including passive motion detectors are also included within the scope of this invention. The scope of the present invention also includes the control of heating, air conditioning systems, and other environmental systems. Additional variations and modifications to the apparatus shown are within the scope of the present invention, which is not to be limited except according to the claims, which follow.

What is claimed is:

1. A motion detection system for providing an output signal in response to detection of entry and continued motion in an area under surveilance, said system comprising:

a signal sensor for providing sensor signals in response to sensed motion in the area;

first means operative to provide two levels of motion detection;

second means operative at a higher level of detection to detect initial entry motion in the area when the sensor signals exceed the higher detection level, and operative at a lower level of detection to detect continued motion in the area where the sensor signal exceed the lower detection level;

said second means having;

third means for lowering the threshold level of said first means to the lower level of detection upon detection of initial entry motion;

fourth means for providing an output signal in response to detection of initial entry motion and for at least as long as there is detection of continual motion at the lower level; and fifth means for restoring the higher level of detection upon cessation of detection of continued motion for a predetermined time.

2. The invention of claim 1 wherein the sensor means includes transmitter means to radiate a signal into the area, and receiver means for receiving a reflected portion of said signal.

3. The invention of claim 1 wherein the second means is operative to maintain the lower level of detection for a finite period of time after cessation of detection of continued motion.

4. The invention of claim 1 wherein said second means includes a retriggerable monostable multivibrator.

5. The invention according to claim 4 wherein the first means includes a threshold circuit providing first and second threshold levels selectable in accordance with signals from said multivibrator.

6. The invention of claim 4 wherein the first means includes a threshold circuit having a single threshold level; and amplifier means having a gain adjustable in response to signals from the multivibrator.

7. The invention of claim 1 further including light control means operative in response to said output signal for switching on lights for the duration of the output signal.

8. A motion detection system for providing an output signal in response to detection of entry and continued motion in an area under surveillance, said system comprising:

a single sensor for providing sensor signals in response to sensed motion in the area;

a first circuit selectively providing a higher threshold level and a lower threshold level, and operative at the higher threshold level to detect sensor signals exceeding the higher threshold level and representing initial entry motion in the area, and operative at the lower threshold level to detect sensor signals exceeding the lower threshold level and representing continued motion in the area;

a second circuit operative in response to signals from the first circuit for providing an output signal;

the first circuit being operative in response to the output signal from the second circuit to reduce the threshold level to the lower level and in the absence of the output signal to provide the upper threshold level;

the second circuit being operative to provide the output signal for so long as signals are received from the first circuit and for a predetermined period of time thereafter.

9. A motion detection system, comprising:

a single sensor having a field of view for providing a sensor signal representation of a subject within the field of view of the sensor means;

dual-level detection means having selectable comparatively-high and comparatively-low detection sensitivity coupled to said sensor means;

means coupled to said single sensor and to said dual-level detection means for providing a control signal in response to the detection of said sensor signal either with said comparatively-high or said comparatively-low detection sensitivities of said dual-level detection means;

switching means coupled to the dual-level detection means for actuating an output device in response to said control signal; and control means coupled to said dual-level detection means and to said single sensor for nominally selecting said comparatively-low detection sensitivity, for selecting said comparatively-high detection sensitivity for a predetermined time interval in response to said sensor signal, and for restoring the comparatively-low detection sensitivity in response to the presence of said sensor signal followed by an absence of said sensor signal for a time that is at least as long as said predetermined time.

* * * * *